US007787788B2

(12) United States Patent
Nakamura

(10) Patent No.: US 7,787,788 B2
(45) Date of Patent: Aug. 31, 2010

(54) FIXING DEVICE AND IMAGE FORMING APPARATUS INCLUDING FIXING DEVICE

(75) Inventor: Kei Nakamura, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 284 days.

(21) Appl. No.: 11/936,444

(22) Filed: Nov. 7, 2007

(65) Prior Publication Data

US 2008/0181645 A1 Jul. 31, 2008

(30) Foreign Application Priority Data

Nov. 7, 2006 (JP) ..... 2006-301636

(51) Int. Cl.
*G03G 15/20* (2006.01)

(52) U.S. Cl. ..... 399/69; 399/67

(58) Field of Classification Search ..... 399/67, 399/69, 328, 329

See application file for complete search history.

(56) References Cited

U.S. PATENT DOCUMENTS 6,347,201 B1 * 2/2002 Sano et al. ..... 399/67
7,130,553 B2 * 10/2006 Sakai ..... 399/69 X
2005/0220466 A1 * 10/2005 Takahashi et al. ..... 399/67 X
2007/0047989 A1 3/2007 Nakamura et al.

FOREIGN PATENT DOCUMENTS

| | | |
|---|---|---|
| JP | 55-164859 | 12/1980 |
| JP | 9-190109 | 7/1997 |
| JP | 11-282293 | 10/1999 |
| JP | 2001-215842 | 8/2001 |
| JP | 2002-365968 | 12/2002 |

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

A fixing device includes a fixing member, pressure member, first temperature detector, and pressure adjustment mechanism. The pressure member presses against the fixing member to form a nip though which a recording medium bearing a toner image thereon is conveyed. The first temperature detector detects a temperature of the fixing member. The pressure adjustment mechanism performs an adjustment to contact pressure between the fixing and pressure members to be lower than an appropriate pressure for image fixing at the detected temperature of the fixing roller or separation of the pressure roller from the fixing member for a part of a period between a time at which a tailing end of a precedent recording medium is conveyed out from the nip and a time at which a leading end of a following recording medium is conveyed into the nip when a plurality of recording media are successively conveyed through the nip.

9 Claims, 7 Drawing Sheets

FIXING DEVICE AND IMAGE FORMING APPARATUS INCLUDING FIXING DEVICE

CROSS-REFERENCE TO RELATED APPLICATION

This application is based on and claims priority from Japanese Patent Application No. 2006-301636, filed on Nov. 7, 2006 in the Japan Patent Office, the entire contents of which are incorporated by reference herein.

BACKGROUND

1. Field of the Invention

Exemplary aspects of the present invention relate to a fixing device, and more particularly to a fixing device including a fixing member, a pressure member, and a temperature detection mechanism to fix a toner image on a recording medium. In addition, the present invention also relates to an image forming apparatus including the fixing device.

2. Description of the Related Art

Image forming apparatuses such as printers, copiers, facsimiles, and multifunctional peripherals capable of serving at least two functions of printer, copier and facsimile have been demanded to reduce the start-up time thereof. Specifically, a fixing device of the image forming apparatus is expected to have reduced the start-up time thereof to meet such demand.

In one example, an attempt is made to reduce the start-up time of a fixing device fixing a toner image on a recording medium by disposing a heating roller acting as a fixing member and a support roller acting as a pressure member. The heating roller includes a cylindrical support member and a resistance-heating layer having a self-temperature-control property. Since the resistance-heating layer is formed along an outer circumference of the cylindrical support member to heat the heating roller, a surface of the heating roller can be easily heated, thereby reducing the start-up time of the fixing device.

Another example attempts to reduce the prolongation of the start-up time of a fixing device employing a fixing belt by disposing a heat source outside a fixing roller. A surface of the fixing roller is covered with an elastic member. Since the heat source is not internally disposed in the fixing roller, the prolongation of the start-up time can be reduced even when the elastic layer increases a thickness thereof.

A related-art fixing device including the above-mentioned examples includes a fixing member and a pressure member. In the course of a fixing process, for example, the fixing member is heated and is pressed against the pressure member to form a nip therebetween. When the recording medium passes through the nip, the toner image carried thereon is fused, thereby fixing the toner image thereon.

In such a related-art fixing device, the fixing member is heated during the start-up time. When a surface of the fixing member reaches an appropriate temperature for the fixing process, the recording medium is conveyed into the nip between the fixing member and the pressure member, thereby fixing the toner image thereon.

For example, when a plurality of recording media successively pass through the nip, an interval is generated between a tailing end of a precedent recording medium and a leading end of a following recording medium. Specifically, the interval is generated between a time at which the tailing end of the precedent recording medium is conveyed out from the nip and a time at which the leading end of the following recording medium is conveyed into the nip. The fixing member and the pressure member contact each other without having the recording medium therebetween during the interval. Consequently, an amount of heat is transferred from the fixing member to the pressure member when the temperature of the pressure member is lower than a certain temperature. For example, the temperature of the pressure member is often lower than the certain temperature shortly after the completion of the start-up time of the fixing member. In this regard, when the fixing member has a relatively low heat capacity, the temperature thereof decreases due to the transfer of the heat therefrom to the pressure member. This heat transfer can cause a decrease in the surface temperature of the fixing member to below the appropriate temperature for the fixing process, resulting in the fixing error of the toner image on the recording medium.

Therefore, a fixing member having a relatively high heat capacity is employed to reduce such a problem. However, such a fixing member needs a longer time period to increase the surface temperature thereof to an appropriate temperature for the fixing process during the start-up, resulting in a longer waiting time for a user.

SUMMARY

According to one aspect of the invention, a fixing device includes a fixing member, a pressure member, a first temperature detection mechanism, and a pressure adjustment mechanism. The pressure member presses against the fixing member to form a nip though which a recording medium bearing a toner image thereon is conveyed with the toner image facing the fixing member to fix the toner image. The first temperature detection mechanism detects a surface temperature of the fixing member. The pressure adjustment mechanism performs at least one of adjustment to contact pressure between the fixing member and the pressure member or separation of the pressure roller from the fixing member when a plurality of recording media are successively conveyed between the fixing member and the pressure member. Specifically, the pressure adjustment mechanism adjusts the contact pressure to be lower than an appropriate pressure for fixing the toner image at the detected surface temperature of the fixing roller. Alternatively, the pressure adjustment mechanism separates the pressure member from the fixing member for at least one part of a time period between a time at which a tailing end of a precedent recording medium is conveyed out from the nip and a time at which a leading end of a following recording medium is conveyed into the nip.

According to another aspect of the present invention, an image forming apparatus includes an image forming mechanism and a fixing device. The image forming mechanism forms an unfixed toner image on a recording medium. The fixing device fixes the unfixed toner image on the recording medium, and includes a fixing member, a pressure member, a first temperature detection mechanism, and a pressure mechanism. The pressure member presses against the fixing member to form a nip though which the recording medium bearing the unfixed toner image thereon is conveyed with the unfixed toner image facing the fixing member to fix the unfixed toner image. The first temperature detection mechanism detects a surface temperature of the fixing member. The pressure adjustment mechanism performs at least one of adjustment to contact pressure between the fixing member and the pressure member or separation of the pressure member from the fixing member when a plurality of recording media are successively conveyed between the fixing member and the pressure member. Specifically, the pressure adjustment mechanism adjusts the contact pressure to be lower than an appropriate pressure for fixing the toner image at the detected surface temperature of the fixing roller. Alternatively, the pressure adjustment mechanism separates the pressure member from the fixing member for at least one part of a time period between a time at which a tailing end of a precedent recording medium is conveyed out from the nip and a time at which a leading end of a following recording medium is conveyed into the nip.

BRIEF DESCRIPTION OF THE DRAWINGS

A more complete appreciation of the exemplary aspects of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
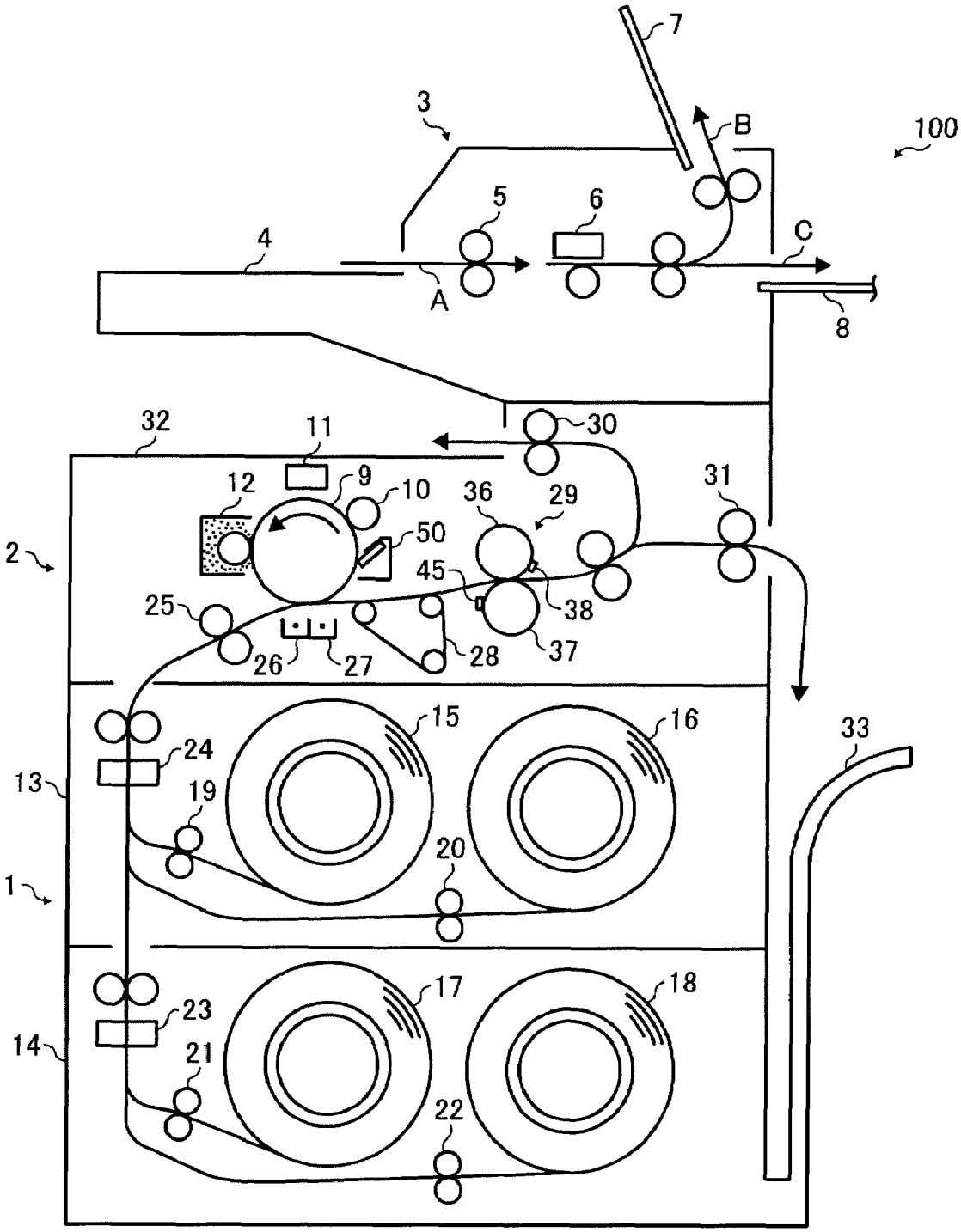
FIG. 1 is a schematic diagram illustrating an image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views thereof, an image forming apparatus according to an exemplary embodiment of the present invention is described.

Referring to FIG. 1, an image forming apparatus 100 includes a sheet feeding unit 1, an image forming unit 2, and an image reading unit 3.

The sheet feeding unit 1 storing a recording medium includes a first roll sheet feeder 13 and a second roll sheet feeder 14. The first roll sheet feeder 13 includes a first roll sheet 15, a second roll sheet 16, first feed rollers 19, second feed rollers 20, and a second cutter unit 24. The second roller sheet feeder 14 includes a third roll sheet 17, a fourth roll sheet 18, third feed rollers 21, fourth feed rollers 22, and a first cutter unit 23.

As shown in FIG. 1, the sheet feeding unit 1 is disposed below the image forming unit 2. Each of the first, second, third, and fourth roll sheets 15, 16, 17, and 18 is a roll of the recording medium wrapped around a paper core. The first, second, third, and fourth feed rollers 19, 20, 21, and 22 are disposed with respect to the first, second, third, and fourth roll sheets 15, 16, 17, and 18, respectively, thereby feeding the respective recording media to the image forming unit 2. Each of the first and second roll sheet feeders 13 and 14 is drawable toward the left of the FIG. 1 so that each of the roll sheets 15, 16, 17, and 18 can be placed and replaced or adjusted when a jam occurs. Each of the first and second cutter units 23 and 24 cuts the recording medium in a suitable length.

The image forming unit 2 includes a photoconductor drum 9, a charger 10, an exposure device 11, a development device 12, a pair of registration rollers 25, a transfer device 26, a separation device 27, a cleaner 50, a conveyance belt 28, a fixing device 29, first ejection rollers 30, second ejection rollers 31, a first ejection area 32, and a second ejection area 33. The fixing device 29 includes a fixing roller 36, a pressure roller 37, a first temperature detector 38, and a second temperature detector 45.

The photoconductor drum 9 acting as an image carrier rotates counterclockwise as indicated by an arrow shown in FIG. 1, and forms an electrostatic latent image thereon by being exposed to laser beam, not shown, from the exposure device 11. The charger 10 charges a surface of the photoconductor drum 9. The exposure device 11 including an LED array modulates and deflects the laser beam based on image information of an original document, not shown, that is read by a reading device 6 of the image reading unit 3, and irradiates the surface of the photoconductor drum 9. The potential of an irradiated area of the photoconductor drum 9 decays, thereby forming the electrostatic latent image on the surface of the photoconductor drum 9. The development device 12 develops the electrostatic latent image on the photoconductor drum 9 with toner to form the toner image. The pair of registration rollers 25 registers the recording medium and feeds toward the photoconductor drum 9 at a desired timing. The transfer device 26 transfers the toner image on the surface of the photoconductor drum 9 onto the recording medium registered by the pair of registration rollers 25. The separation device 27 separates the recording medium having the toner image thereon from the photoconductor drum 9. The conveyance belt 28 conveys the recording medium. The cleaner 50 removes remaining toner from the surface of the photoconductor 9. The fixing device 29 fixes the toner image on the recording medium through a fixing process for an image fixing. The fixing device 29 will be described in detail with reference to FIG. 2. The photoconductor drum 9, the charger 10, the exposure device 11, the development device 12, the transfer device 26, the separation device 27, and the cleaner 50 form an image forming mechanism. The first ejection rollers 30 eject the recording medium having the fixed toner image thereon to the first ejection area 32. Similarly, the second ejection rollers 31 eject the recording medium to the second ejection area 33.

The image reading unit 3 includes an original table 4, side fence, not shown, fifth feed rollers 5, the reading device 6, a first ejection tray 7, and a second ejection tray 8.

The image reading unit 3 is disposed above the image forming unit 2. The original table 4 is on which the original document is placed, and includes an original width detection sensor, not shown, and an original length detection sensor, not shown. The original width and length detection sensors detect the size of the original document placed on the original table 4. The side fence aligns a position of the original document in a width direction. The fifth feed rollers 5 feed the recording media in a direction indicated by an arrow A shown in FIG. 1. The reading device 6 employing a close-contact method includes a rod lens array, not shown, and an image sensor, not shown. In the course of the original reading by the reading device 6, the original document is fed under the reading device 6 so that a light source, not shown, such as the LED array and the fluorescent light irradiates the original with the light. Subsequently, the original reflects the light, and the reflected light reaches the image sensor through the rod lens.

The image sensor forms an image of the original document and converts photoelectrically into an electric signal. Upon completion of the original reading, the original document is conveyed in a direction indicated by an arrow B shown in FIG. 1, and is ejected on the first ejection tray 7. The original document can be conveyed in a direction indicated by an arrow C shown in FIG. 1, and is ejected on the second ejection tray 8. The image forming unit 3 also includes an operation unit, not shown, that instructs the beginning of the printing operation and manipulates information such as the length of the recording medium and the number of recording media for repeat copy.

The image forming apparatus 100 employs the first, second, third, and fourth roll sheets 15, 16, 17, and 18. Alternatively, a transfer sheet such as a resin film and a cut-sheet that is cut in a desired size beforehand may be employed as the recording medium.

Figure 2:
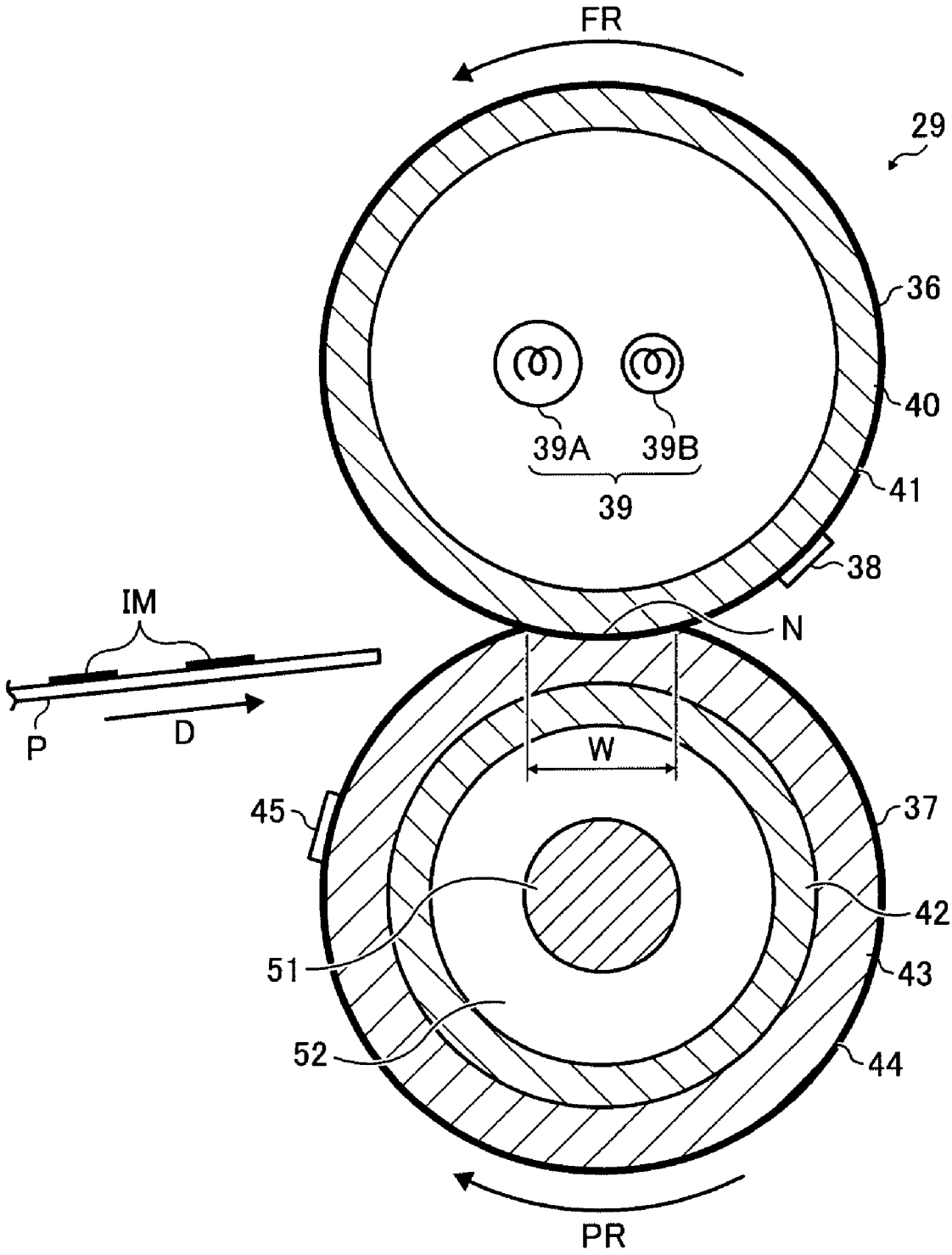
FIG. 2 is a schematic diagram illustrating a fixing device of the image forming apparatus of FIG. 1.

Referring to FIG. 2, the fixing device 29 of FIG. 1 is enlarged. The fixing device 29 includes the fixing roller 36 acting as a fixing member, the pressure roller 37 acting as a pressure member, the first temperature detector 38 detecting the surface temperature of the fixing roller 36, a heating mechanism 39 heating the fixing roller 36, and the second temperature detector 45 detecting the surface temperature of the pressure roller 37. Descriptions of elements in FIG. 2 that have already been described with respect to FIG. 1 are omitted as redundant.

The fixing roller 36 includes a metal pipe 40 comprised of aluminum or carbon steel, for example, and a first release layer 41 laminated on an outer circumference of the metal pipe 40. The pressure roller 37 includes a core metal 42, an elastic layer 43, and a second release layer 44. The core metal 42 is a pipe shape and is comprised of aluminum or carbon steel, for example. The elastic layer 43 is secured to an outer circumference of the core metal 42, and is comprised of silicon rubber, for example. The second release layer 44 is laminated on an outer circumference of the elastic layer 43. A shaft 51 is disposed in the pressure roller 37 and penetrates therethrough. A circular plate 52 is disposed in the pressure roller 37. The shaft 51 and the circular plate 52 will be described in detail with reference to FIG. 5. The pressure roller 37 and the fixing roller 36 are pressed against each other so that the elastic layer 43 becomes deformed by the pressure, thereby forming a nip N between the fixing roller 36 and the pressure roller 37. The first temperature detector 38, for example, includes a thermistor or a temperature sensor that contacts the circumference surface of the fixing roller 36. The heat mechanism 39 is internally disposed in the fixing roller 36 and includes a first heater 39A and a second heater 39B. For example, a halogen heater, a nichrome wire heater, and an induction heater can be applied as the first and second heaters 39A and 39B. The recording media and the toner image thereon are indicated by P and IM, respectively in FIG. 2. The fixing device 29 performs the image fixing during which the toner image IM on the recording media P is fixed thereon. The fixing device 29 including the fixing process is described in detail below.

The fixing roller 36 is rotationally driven by a drive unit, not shown, in a counterclockwise direction indicated by an arrow FR shown in FIG. 2. The pressure roller 37 is rotationally driven by the rotation of the fixing roller 36 in a clockwise direction indicated by an arrow PR shown in FIG. 2. The first temperature detector 38 detects the surface temperature of the fixing roller 36. The power distribution to the first and second heater 39A and 39B is controlled such that the surface temperature of the fixing roller 36 becomes an appropriate temperature for the image fixing. The recording medium P bearing the toner image IM thereon is conveyed in a direction indicated by an arrow D shown in FIG. 2 such that the toner image IM contacts the fixing roller 36. When the recording medium P passes through the nip N, the pressure roller 37 presses against the fixing roller 36, thereby applying the pressure and heat to the toner image IM on the recording medium P. Consequently, the toner image IM is fixed on the recording medium P.

The fixing device 29 of FIG. 2 employs the fixing roller 36 as the fixing member and the pressure roller 37 as the pressure member. Alternatively, a fixing member having a fixing belt may be employed, and a pressure belt may be employed as the pressure member. The fixing member having the fixing belt will be described in detail with reference to FIG. 8.

As described above, the fixing device 29 according to the exemplary embodiment of the present invention includes the fixing roller 36 acting as the fixing member, the pressure roller 37 acting as the pressure member, and the first temperature detector 38 acting as the temperature detection mechanism. The recording medium P bearing the toner image IM is conveyed through the nip N, thereby fixing the toner image IM on the recording medium P.

Figure 3A:
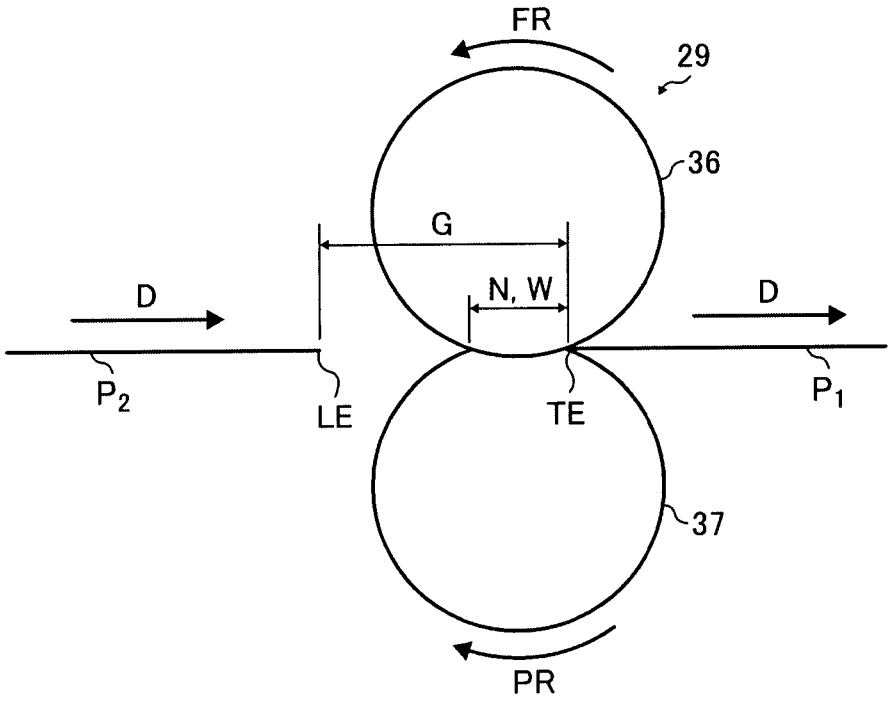
FIG. 3A is a schematic diagram illustrating the fixing device of FIG. 2 when a recording medium is conveyed out from a nip between a fixing roller and a pressure roller.
Figure 3B:
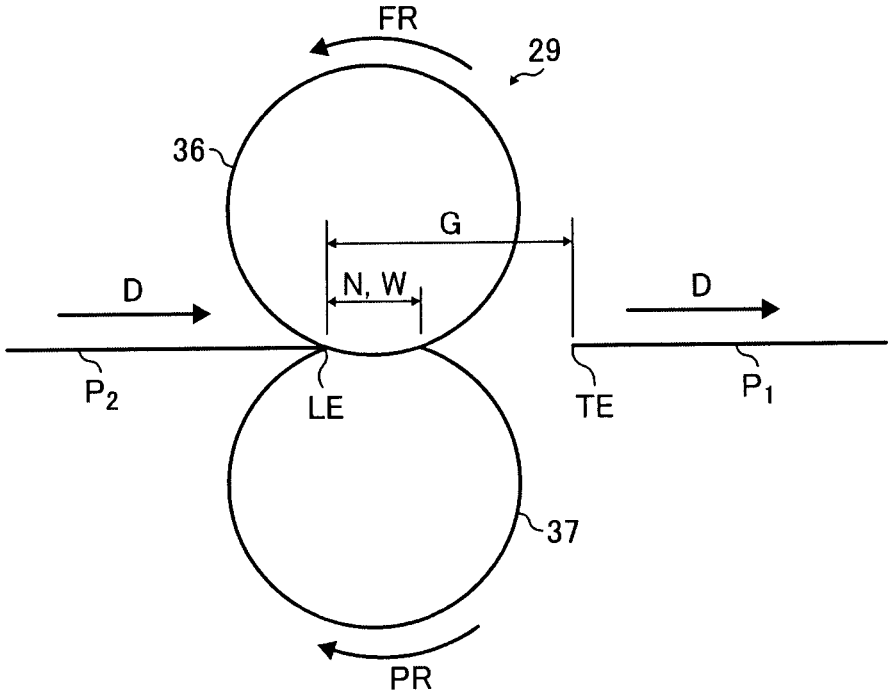
FIG. 3B is a schematic diagram illustrating the fixing device of FIG. 2 when another recording medium is conveyed in the nip between the fixing roller and the pressure roller.

Referring to FIGS. 3A and 3B, a plurality of recording media P are successfully conveyed through the nip N formed between the fixing roller 36 and the pressure roller 37 of the fixing device 29. The plurality of recording media P include a precedent sheet P1 and a following sheet P2 for the sake of simplicity. The precedent sheet P1 has a tailing end TE, and the following sheet P2 has a leading end LE. The nip N has a nip width W in a conveyance direction of the recording medium P. Descriptions of elements in FIGS. 3A and 3B that have already been described with respect to FIGS. 1 and 2 are omitted as redundant.

FIG. 3A illustrates a first example situation in which the tailing end TE of the precedent sheet P1 is conveyed out from the nip N between the fixing roller 36 and the pressure roller 37. FIG. 3B illustrates a second example situation in which the leading end LE of the following sheet P2 is conveyed into the nip N. As shown in FIGS. 3A and 3B, the precedent sheet P1 and the following sheet P2 have a gap G therebetween.

Consequently, a sheet interval is provided between a time at which the tailing end TE of the precedent recording sheet P1 is conveyed out from the nip N and a time at which the leading end LE of the following sheet P2 is conveyed into the nip N. Since the fixing roller 36 and the pressure roller 37 contact each other during the sheet interval without having the recording medium P such as the precedent sheet P1 and the following sheet P2 therebetween, the fixing device 29 of the exemplary embodiment employs a pressure adjustment mechanism 80 to adjust the pressure produced by contacting the fixing roller 36 and the pressure roller 37 in the nip N. Such pressure is hereafter referred to as contact pressure. The sheet interval is abbreviated as SI and described in detail with reference to FIG. 4.

More specifically, a related-art fixing device causes heat transfer from a fixing roller to a pressure roller when temperature of the pressure roller is below a certain temperature. This heat transfer decreases surface temperature of the fixing roller to below an appropriate temperature for image fixing, resulting in an fixing error of a toner image to a recording medium. However, according to the exemplary embodiment, the pressure adjustment mechanism 80 of the fixing device 29 adjusts the contact pressure produced by contacting the fixing roller 36 and the pressure roller 37 in the nip N, thereby reducing the amount of the heat transfer from the fixing roller 36 to the pressure roller 37. The pressure adjustment mechanism 80 is described below.

The pressure adjustment mechanism 80 adjusts the contact pressure during the sheet interval when the plurality of recording media are successively conveyed through the nip N. Specifically, the pressure adjustment mechanism 80 adjusts the contact pressure between the fixing roller 36 and the pressure roller 37 during the sheet interval such that the contact pressure becomes lower than a suitable pressure for the image fixing at the detected surface temperature of the pressure roller 36. Therefore, when the pressure roller 37 and the fixing roller 36 contact each other during the sheet interval without the recording medium P therebetween, the pressure adjustment mechanism 80 reduces the contact pressure to be lower than the suitable pressure for the image fixing. This reduction of the contact pressure allows the size of the nip width W to be smaller, thereby not only reducing the amount of the heat transfer from fixing roller 36 to the pressure roller 37, but also reducing the decrease in temperature of the fixing roller 36. Therefore, the fixing device 29 of the exemplary embodiment can reduce the fixing error of the toner image to the recording medium P. The pressure adjustment mechanism 80 is further described in detail with reference to FIGS. 4, 5, 6, and 7.

Figure 4:
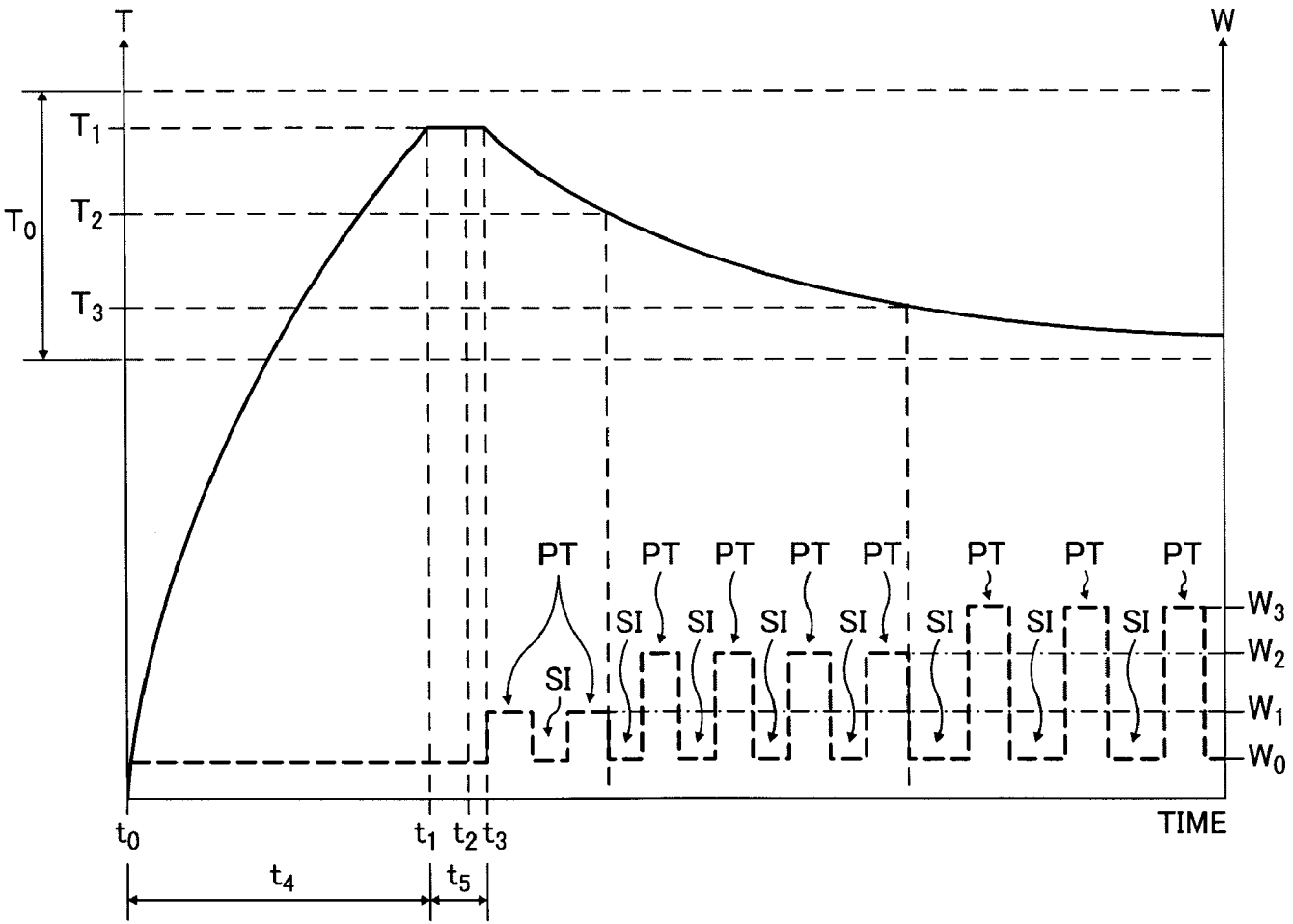
FIG. 4 is a chart illustrating relationships among temperature of the fixing roller of FIGS. 3A and 3B, a nip width of the nip of FIGS. 3A and 3B, and time of image fixing.

FIG. 4 is a chart illustrating relationships among the surface temperature of the fixing roller 36, the nip width W, and the time of the image fixing. The x, y, and z axes represent the image fixing time, a surface temperature T of the fixing roller 36, and the nip width W, respectively. Each of the x, y, and z axes has reference symbols described below.

The x-axis represents the time at which the fixing device 29 performs the image fixing. The reference time symbols used for the x-axis are as follows.

t0: The power distribution to the first and second heaters 39A and 39B is started so that the fixing roller 36 is heated and the surface temperature T thereof begins to increase. The fixing roller 36 and the pressure roller 37 are at a halt.

t1: The surface temperature T of the fixing roller 36 reaches a target temperature T1 that is described later.

t2: Each of the fixing roller 36 and the pressure roller 37 begins to rotate in directions FR and PR shown in FIG. 2 respectively when the operation unit instructs the beginning of the printing operation.

t3: The plurality of recording media P are successively conveyed through the nip N.

t4: The fixing roller 36 is heated and the surface temperature T of the fixing roller 36 reaches the target temperature T1 during the time period t4 that is also referred to as a start-up time of the fixing device 29.

t5: A time period between the completion of the start-up time of the fixing device 29 and the beginning of conveyance of a first recording medium into the nip N.

The y-axis represents the surface temperature T of the fixing roller 36. The reference temperature symbols used for the y-axis are as follows.

T0: An appropriate temperature range for the image fixing. The range T0 includes T1, T2, and T3 described below and is also referred to as the fixing temperature.

T1: A target temperature for the surface temperature T of the fixing roller 36.

T2: A temperature within the appropriate temperature range T0 for the image fixing but below T1.

T3: A temperature within the appropriate temperature range T0 but below T2.

The z-axis represents the size of the nip width W. The reference width symbols used for the z-axis are as follows.

W0: A size of the nip width W during the sheet interval SI. The size W0 is relatively small.

W1: A size of the nip width W when T1≧T≧T2. The size W1 is larger than W0.

W2: A size of the nip width W when T2>T>T3. The size W2 is larger than W1.

W3: A size of the nip width W when T≦T3. The size W3 is larger than W2.

Descriptions of elements in FIG. 4 that have already been described with respect to FIGS. 1 through 3 are omitted as redundant.

As shown in the chart of FIG. 4, the image fixing begins at time t0 when the power distribution to the first and second heaters 39A and 39B is started to heat the fixing roller 36. When the surface temperature T of the fixing roller 36 reaches the target temperature T1 at time t1, the power distribution to the first and second heaters 39A and 39B is controlled such that the surface temperature T can remain at the target temperature T1. The fixing roller 36 and the pressure roller 37 begin to be rotated in the directions FR and PR, respectively as shown in FIG. 2 at time t2. The first sheet of the plurality of recording media P begins to pass through the nip N between the fixing roller 36 and the pressure roller 37 at time t3. Subsequently, the plurality of the recording media P are successively conveyed through the nip N with the sheet interval between adjacent two recording media P as shown in FIGS. 3A and 3B. The sheet interval is abbreviated as SI in FIG. 4. When each of the plurality of recording media P is conveyed through the nip N, the toner image thereon is fixed by application of the heat and pressure. A period of time in which each of the recording media P passes between the fixing roller 36 and the pressure roller 37 is referred to as a passage time and is abbreviated as PT in FIG. 4.

When the plurality of the recording media P begin to pass through the nip N at time t3, the heat transfer occurs from the fixing roller 36 to each of the plurality of recording media P and the pressure roller 37, resulting in a gradual decrease in the surface temperature T of the fixing roller 36 to below the target temperature T1.

In this regard, the pressure adjustment mechanism 80 adjusts the contact pressure between the fixing roller 36 and the pressure roller 37 such that the nip width W increases with a decrease in the surface temperature T of the fixing roller 36.

Specifically, as shown in FIG. 4, when the surface temperature T of the fixing roller 36 is ranged between the target temperature T1 and the temperature T2, the pressure adjustment mechanism 80 adjusts the contact pressure such that the nip width W becomes the size of W1 which is relatively larger than that of W0 but smaller than that of W2. When the surface temperature T is ranged between the temperature T2 and T3, the nip N is adjusted to be the size of W2 which is relatively larger than that of W1. The pressure adjustment mechanism 80 also adjusts the contact pressure such that the nip width W becomes the size of W3 which is larger than that of W2 when the surface temperature T is below the temperature T3. Therefore, the nip width W of the nip N between the fixing roller 36 and the pressure roller 37 increases with the decrease in the surface temperature T of the fixing roller 36. In this regard, the fixing roller 36 can reduce the decrease of heat supply therefrom to the toner image for the image fixing due to the decrease in the surface temperature T.

Accordingly, the pressure adjustment mechanism 80 of the exemplary embodiment gradually adjusts the contact pressure applied during the passage time PT such that the nip width W increases as the surface temperature T detected by the first temperature detector 38 of FIG. 2 decreases.

According to the fixing device 29 of the exemplary embodiment, the fixing roller 36 and the pressure roller 37 are employed. Alternatively, another fixing member and another pressure member may be employed.

In addition, the pressure adjustment mechanism 80 adjusts the contact pressure during each sheet interval SI when the plurality of recording media P are successively conveyed through the nip N as described above with reference to FIGS. 3A and 3B. Specifically, the pressure adjustment mechanism 80 adjusts the contact pressure to be relatively low during the sheet interval SI while arranging the nip width W of the nip N to be the size of W0 which is smaller than that of W1. Therefore, the pressure adjustment mechanism 80 can reduce the amount of the heat transfer from the fixing roller 36 to the pressure roller 37 even when the fixing roller 36 and the pressure roller 37 contact each other during the sheet interval SI without the recording medium P therebetween. Consequently, the fixing roller 36 can reduce a sharp decrease in the surface temperature T thereof, thereby reducing the fixing error of the toner image to the recording medium P.

According to the above-described embodiment, the pressure adjustment mechanism 80 adjusts the contact pressure between the fixing roller 36 and the pressure roller 37 so that the size of nip width W becomes W0 during each sheet interval SI. Alternatively, the size of nip width W may be W0 during at least one part of each sheet interval SI.

According to the above-described embodiment, the pressure adjustment mechanism 80 adjusts the contact pressure between the fixing roller 36 and the pressure roller 37 so that the size of nip width W becomes W0 during each sheet interval SI or at least one part of each sheet interval SI. Alternatively, the pressure adjustment mechanism 80 may separate the pressure roller 37 from the fixing roller 36, thereby further reduction in the amount of the heat transfer from the fixing roller 36 to the pressure roller 37.

In other words, the pressure adjustment mechanism 80 adjusts the contact pressure between the fixing roller 36 and the pressure roller 37 to be lower than the suitable pressure for the image fixing at the detected surface temperature of the fixing roller 36 when the plurality of recording media P are successively conveyed between the fixing roller 36 and the pressure roller 37. Specifically, such an adjustment is made during at least one part of the sheet interval SI between the time at which the tailing end TE of the precedent recording medium P1 is conveyed out from the nip N and the time at which the leading end LE of the following recording medium P2 is conveyed into the nip N. The pressure adjustment mechanism 80 can also separate the pressure roller 37 from the fixing roller 36 during at least one part of the sheet interval SI when the plurality of recording media P are successively conveyed between the fixing roller 36 and the pressure roller 37.

In addition, when the fixing device 29 performs the image fixing for a lengthy time period, for example, by successively conveying the plurality of recording media P, the temperature of the pressure roller 37 increases to a certain temperature. Such a temperature increase of the pressure roller 37 can allow reduction in the amount of the heat transfer from the fixing roller 36 to the pressure roller 37 even when the fixing roller 36 and the pressure roller 37 contact each other during the sheet interval SI. In other words, the fixing roller 36 and the pressure roller 37 can remain contacted with the contact pressure therebetween during the sheet interval SI. In this regard, the second temperature detector 45 of FIG. 2 is employed to detect the surface temperature of the pressure roller 37. For example, the second temperature detector 45 includes a thermistor. The pressure adjustment mechanism 80 adjusts the contact pressure during at least one part of the sheet interval SI such that the contact pressure between the fixing roller 36 and the pressure roller 37 is lower than the suitable pressure for the image fixing at the detected surface temperature of the fixing roller 36 when the surface temperature of the pressure roller 37 is below a predetermined temperature. The pressure adjustment mechanism 80 can also separate the pressure roller 37 from the fixing roller 36 during at least one part of the sheet interval SI when the surface temperature of the pressure roller 37 is below the predetermined temperature.

Specifically, as shown in FIG. 4, the pressure adjustment mechanism 80 adjusts the contact pressure to be relatively low such that the size of the nip width W is W0 during the time period t4. As described above, the time period t4 is also referred to as the start-up time of the fixing device 29 during which the fixing roller 36 is heated to reach the target temperature T1. The pressure adjustment mechanism 80 can also separate the pressure roller 37 from the fixing roller 36 during the start-up time. Therefore, the pressure adjustment mechanism 80 can reduce the amount of heat transfer from the fixing roller 36 to the pressure roller 37, thereby shortening the start-up time of the fixing device 29.

In addition to the time period t4 of FIG. 4, the size of the nip width W is arranged to be W0 during the time period t5 which is between the completion of the start-up time of the fixing device 29 and the beginning of medium conveyance to the nip N. The pressure adjustment mechanism 80 can not only adjust the contact pressure to be relatively low such that the size of the nip width W becomes W0 during the time period t5, but can also separate the pressure roller 37 from the fixing roller 36 during the time period t5. Therefore, the heat transfer from the fixing roller 36 to the pressure roller 37 can be reduced during the time period t5.

Moreover, when the surface temperature T of the fixing roller 36 is below the temperature T3 as shown in FIG. 4, the pair of registration rollers 25 of FIG. 1 adjusts the feed timing of each of the recording media P such that the gap G between adjacent two recording media P widens. In other words, the sheet interval SI between adjacent two recording media P becomes longer. For example, when the surface temperature T is below the temperature T3 within the fixing temperature T0, the registration rollers 25 adjust each gap G to widen in the course of successively conveying the plurality of recording media P. Such an adjustment can not only reduce the amount of the heat transfer from the fixing roller 36 to each of the recording media P, but can also reduce the decrease in surface temperature T of the fixing roller 36, thereby keeping the surface temperature T within the temperature T0. Therefore, when the surface temperature T detected by the first temperature detector 38 is below the temperature T3 while successively conveying the plurality of recording media P through the nip N to fix respective toner images IM thereon, the pair of registration rollers 25 adjusts the feed timing of each of plurality of recording media P to the nip N such that the gap G between the tailing end TE of the precedent recording medium P1 and the leading end LE of the following recording medium P2 of FIGS. 3A and 3B widens.

More specifically, a related-art fixing device causes the heat transfer from a fixing member to a pressure member during a sheet interval, resulting in the decrease of surface temperature of the fixing member in a relatively short time period from the beginning of sheet conveyance. In this regard, the related-art fixing device needs to increase the sheet interval so as to reduce the decrease of surface temperature of the fixing member. Consequently, the related-art fixing device needs a lengthy time period to fix respective images on a plurality of recording media and a relatively large amount of energy for the image fixing.

By contrast, the fixing device 29 of the above-described embodiment can reduce the amount of the heat transfer from the fixing roller 36 to the pressure roller 37, thereby consuming a longer time period for the surface temperature T of the fixing roller 36 to reach the temperature T3 from the beginning of the medium conveyance. In this regard, the fixing device 29 can delay the beginning of increase in the sheet interval, thereby fixing the toner images on the plurality of recording media P in a relatively short time period and also reducing the energy consumption for the image fixing.

Figure 5:
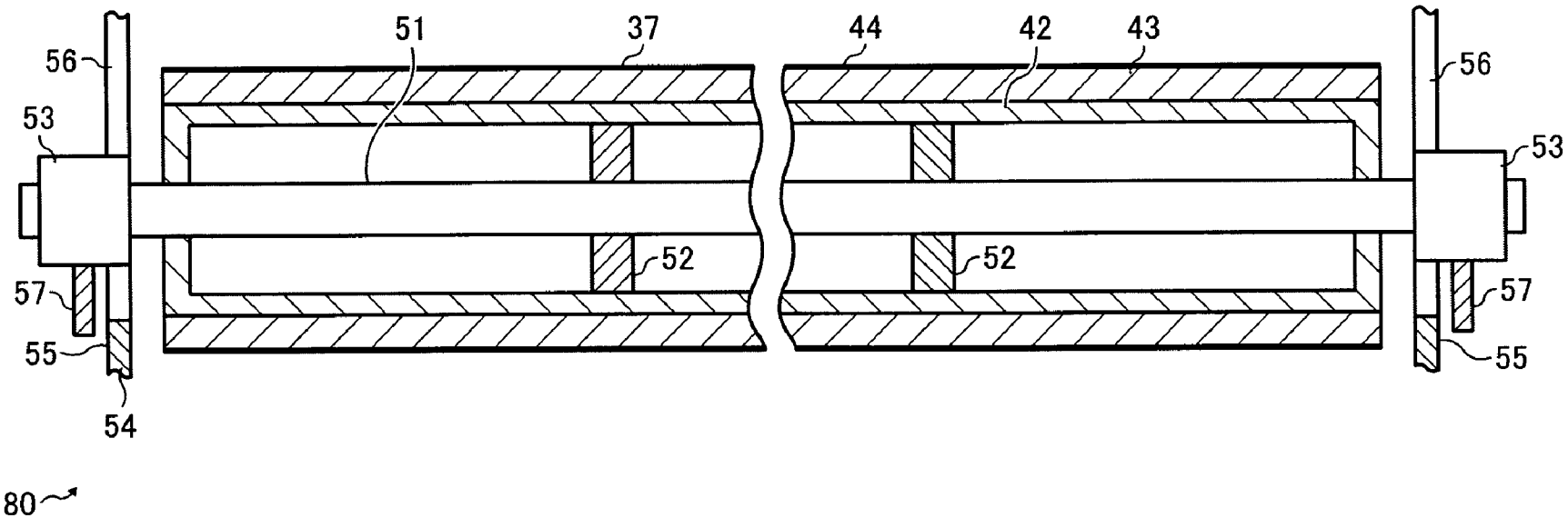
FIG. 5 is a schematic sectional view illustrating a pressure adjustment mechanism for the fixing device of FIG. 2.
Figure 6:
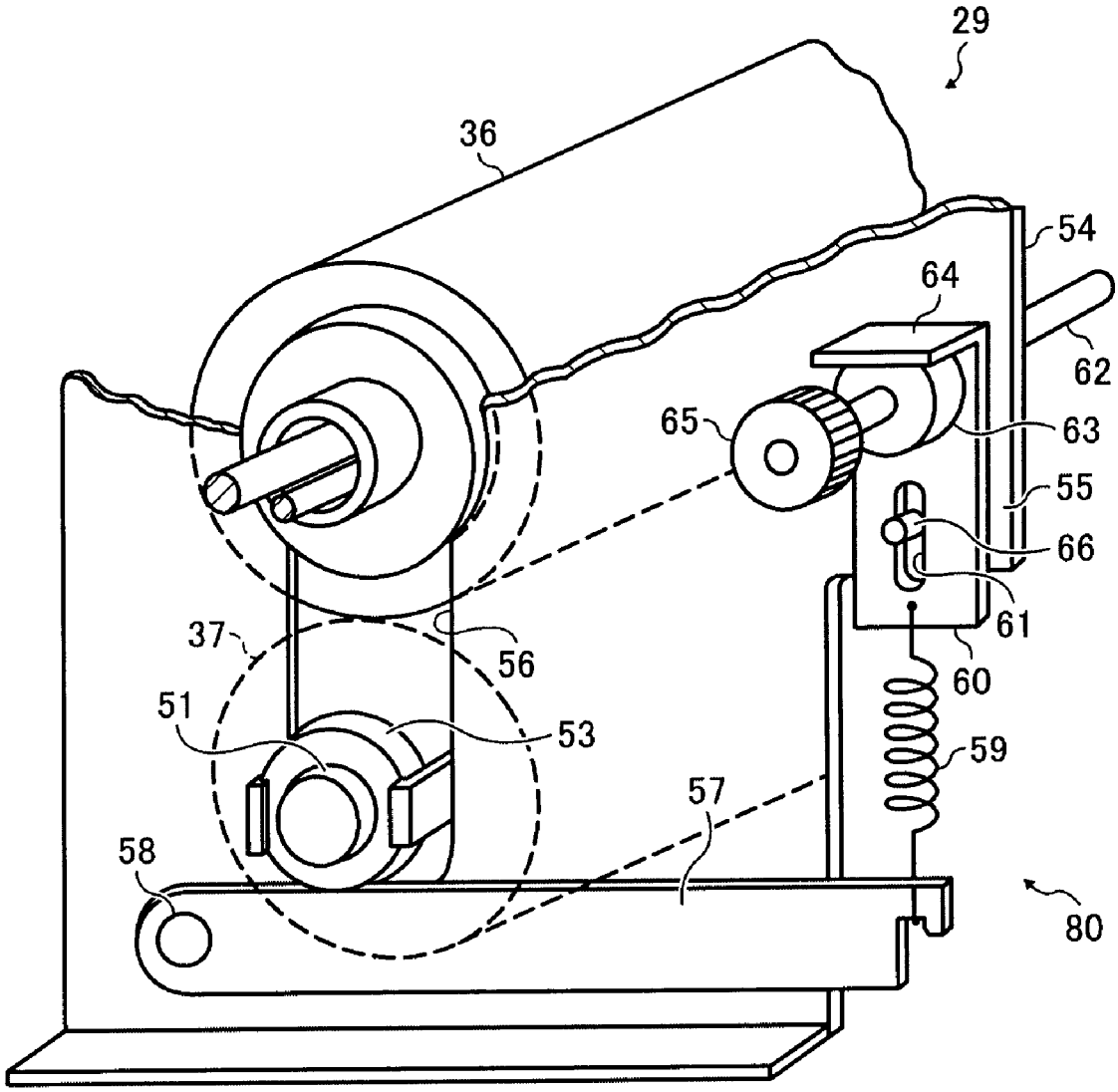
FIG. 6 is another schematic perspective view illustrating the pressure adjustment mechanism of FIG. 5.
Figure 7:
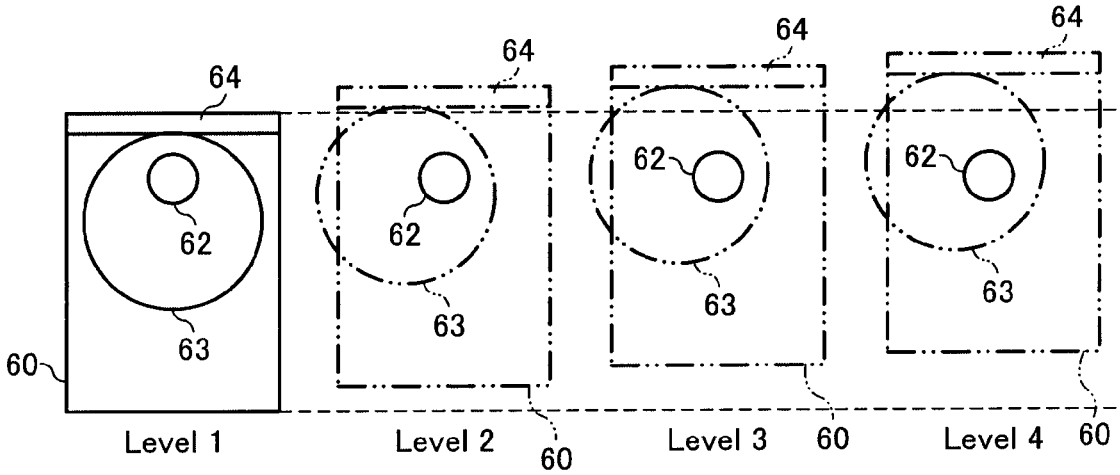
FIG. 7 is a schematic diagram illustrating various positions of a movable plate of the pressure adjustment mechanism of FIG. 6.

A description is now given of an example of the pressure adjustment mechanism 80 with reference to FIGS. 5, 6, and 7. Descriptions of elements in FIGS. 5 and 6 that have already been described with respect to FIGS. 1 through 4 are omitted as redundant.

As shown in FIGS. 5 and 6, the shaft 51 of FIG. 2 is disposed in the pressure roller 37 and extends therethrough while being secured relative to the pressure roller 37. The circular plate 52 of FIG. 2 is disposed within an area in which the shaft 51 is disposed inside the pressure roller 37, and is secured by being pressed against the inside circumference face of the pressure roller 37. The shaft 51 has first bearings 53 engaged with both ends thereof in a longitudinal direction, and is rotatably mounted to a casing 54 of the fixing device 29 through the first bearings 53. The casing 54 includes side plates 55 each of which has a first slot 56. Each of the first bearing 53 is slidably engaged with the first slot 56 in the longitudinal direction thereof. The fixing roller 36 is supported to the side plates 55 at both ends thereof in a longitudinal direction through respective second bearings, not shown, so as to be immovably positioned while being rotatable.

Each of the first bearings 53 is engaged with respective end of the shaft 51, and pressure levers 57 are disposed below the first bearings 53. One end of each of the pressure levers 57 is swingably supported to one of the side plate 55 of the casing 54 through a first pin 58, while another end of each of the pressure levers 57 is connected to one end of a tensile spring 59. Another end of the tensile spring 59 is connected to a bottom area of a movable plate 60 that includes a second slot 61, a third slot, not shown, and a bent portion 64. The side plate 55 includes a second pin 66 protruding therefrom. The second slot 61 is slidably engaged with the second pin 66 so that the movable plate 60 makes a vertical movement along the side plate 55. A rotation shaft 62 penetrates the side plate 55 and the third slot of the movable plate 60, and is immovably positioned while being rotatable relative to the side plate 55. A cam 63 is secured to the rotation shaft 62. Therefore, the movable plate 60 makes the vertical movement by a movement of the tensile spring 59 without interference by the rotation shaft 62 so that the bent portion 64 thereof presses against the cam 63. As shown in FIG. 6, the pressure adjustment elements such as the pressure lever 57, the tensile spring 59, the movable plate 60, and the cam 63 are disposed in one end of the pressure roller 37. Similarly, these elements are disposed in another end of the pressure roller 37. Therefore, the pressure roller 37 presses against the fixing roller 36. The fixing roller 36 is rotationally driven by the drive unit, and the pressure roller 37 is rotationally driven with the shaft 51 with the rotation of the fixing roller 36.

As shown in FIG. 6, a gear 65 is secured to one end of the rotation shaft 62 and is connected to a motor, not shown, through an intermediate gear, not shown.

Upon rotation of the motor, the gear 65 and the cam 63 are rotated so that the movable plate 60 makes the vertical movement. The upper position of the movable plate 60 in the substantially vertical direction, the greater amount of the contact pressure between the fixing roller 36 and the pressure roller 37. Consequently, the size of the nip width W between the fixing roller 36 and the pressure roller 37 increases. The vertical movement of the movable plate 60 is described in detail with reference to FIG. 7.

FIG. 7 illustrates changes in positions of the movable plate 60 in four levels. Descriptions of elements in FIG. 7 that have already been described with respect to FIGS. 1 and 6 are omitted as redundant.

A level 1 of FIG. 7 represents an example position of the movable plate 60 when the size of the nip width W is W0 during the sheet interval SI of FIG. 4. The cam 63 is rotated in a position shown in the level 1 of FIG. 7, and the movable plate 60 is in a lowest position among four levels. The horizontal dotted lines in FIG. 7 represent the vertical position of the movable plate 60 in the level 1 in order to compare with positions of the movable plate 60 in the level 2 to level 4. The pressure adjustment mechanism 80 adjusts the pressure control so that the size of the nip width W become W0 in the level 1. Such an adjustment can reduce the amount of heat transfer from the fixing roller 36 to the pressure roller 37.

The level 2 of FIG. 7 represents another example position of the movable plate 60 when the size of the nip width W is W1 of FIG. 4. For example, when the surface temperature T of the fixing roller 36 decreases during the passage time PT as shown in FIG. 4, the movable plate 60 changes the position thereof by making a substantially vertical movement such that the size of the nip width W increases. In other words, when the surface temperature T of the fixing roller 36 is between T1 and T2 ($T1 \geqq T \geqq T2$) as shown in FIG. 4, the position of the movable plate 60 moves up in the substantially vertical direction so that the size of the nip width W becomes W1.

A level 3 of FIG. 7 represents yet another example position of the movable plate 60 when the size of the nip width W is W2 of FIG. 4. For example, when the surface temperature T is between T2 and T3 (e.g., $T2>T>T3$), the position of the movable plate 60 moves further up in the substantially vertical direction compared to that of the level 2. Such a movement increases the size of the nip width W to W2 which is larger than that of W1.

A level 4 of FIG. 7 represents another example position of the movable plate 60 when the size of the nip width W is W3 of FIG. 4. When the temperature T is below T3 (e.g., $T \leqq T3$), the movable plate 60 moves to a highest position among the four levels so that the size of the nip width W becomes W3 which is larger than that of W2. The size of nip width W gradually increases with decrease in the surface temperature T of the fixing roller 36, thereby reducing a shortage of heat amount to fix the toner image.

According to the level 1, the pressure roller 37 contacts the fixing roller 36 with the size of the nip width W0. Alternatively, the pressure adjustment mechanism 80 can separate the pressure roller 37 from the fixing roller 36 when the cam 63 is positioned as shown in the level 1. Therefore, the pressure adjustment mechanism 80 not only adjust the nip width W of the nip N between fixing roller 36 and the pressure roller 37, for example, the level 1 to level 4, but also separate the pressure roller 37 from the fixing roller 36.

In addition to the fixing device 29, the exemplary embodiment can be applied to a fixing device 290 employing a fixing belt 360A. The fixing device 290 is described in detail with respect to FIG. 8.

Figure 8:
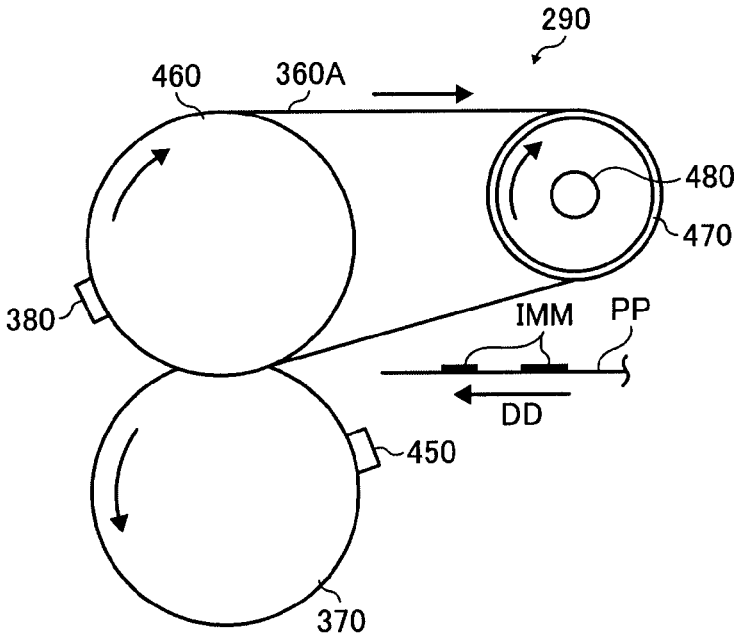
FIG. 8 is a schematic diagram illustrating a fixing device employing a fixing belt according to another exemplary embodiment of the present invention.

FIG. 8 illustrates the fixing device 290 including the fixing belt 360A, a pressure roller 370, a first detector 380, a second detector 450, a support roller 460, a heating roller 470, and a heater 480.

The fixing belt 360A acting as a fixing member is tightly stretched by the support roller 460 and the heating roller 470. The pressure roller 370 presses a surface of the fixing belt 360A around the support roller 460. The heating roller 470 includes the heater 480 therein. In the course of fixing operation, the support roller 460, the pressure roller 370, the fixing belt 360A, and the heating roller 470 are rotationally driven in respective directions indicated by arrows shown in FIG. 8. The heater 480 acting as a heating mechanism heats the heating roller 470, thereby heating the fixing belt 360A. The first detector 380 and the second detector 450 detect the surface temperature of the fixing belt 360A and the pressure roller 370, respectively. A recording media PP bearing a toner image IMM thereon is conveyed in a direction indicated by an arrow DD shown in FIG. 8. The toner image IMM is fixed on the recording media PP by application of heat and pressure.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A fixing device comprising:

a fixing member;

a pressure member which presses against the fixing member to form a nip though which a recording medium bearing a toner image thereon is conveyed with the toner image facing the fixing member to fix the toner image;

a first temperature detection mechanism which detects a surface temperature of the fixing member;

a second temperature detection mechanism which detects a surface temperature of the pressure member; and a pressure adjustment mechanism which reduces contact pressure between the fixing member and the pressure member when the surface temperature of the pressure member is lower than a predetermined temperature.

2. The fixing device according to claim 1, wherein when the surface temperature of the pressure member is lower than a predetermined temperature, the pressure adjustment mechanism performs at least one of adjustment to contact pressure between the fixing member and the pressure member to be lower than an appropriate pressure for fixing the image at the detected surface temperature of the fixing roller or separation of the pressure member from the fixing member for at least one part of a time period between a time at which a tailing end of a precedent recording medium is conveyed out from the nip and a time at which a leading end of a following recording medium is conveyed into the nip when a plurality of recording media are successively conveyed between the fixing member and the pressure member.

3. The fixing device according to claim 1, wherein the pressure adjustment mechanism gradually adjusts the contact pressure during the conveyance of the recording medium between the fixing member and the pressure member such that a width of the nip formed between the fixing member and the pressure member increases with decrease in the surface temperature of the fixing member detected by the first temperature detection mechanism.

4. The fixing device according to claim 1, wherein the pressure adjustment mechanism performs at least one of adjustment to the contact pressure to be a minimum pressure or separation of the pressure member from the fixing member such that the surface temperature of the fixing member reaches a target temperature when the fixing member is heated during a start-up time.

5. An image forming apparatus comprising:

an image forming mechanism which forms an unfixed toner image on a recording medium; and a fixing device which fixes the unfixed toner image on the recording medium, the fixing device comprising:

a fixing member;

a pressure member which presses against the fixing member to form a nip though which the recording medium bearing the unfixed toner image thereon is conveyed with the unfixed toner image facing the fixing member to fix the unfixed toner image;

a first temperature detection mechanism which detects a surface temperature of the fixing member;

a second temperature detection mechanism which detects a surface temperature of the pressure member; and a pressure adjustment mechanism which reduces contact pressure between the fixing member and the pressure member when the surface temperature of the pressure member is lower than a predetermined temperature.

6. The image forming apparatus according to claim 5, wherein the pressure adjustment mechanism performs at least one of adjustment to contact pressure between the fixing member and the pressure member to be lower than an appropriate pressure for fixing the toner image at the detected surface temperature of the fixing roller or separation of the pressure member from the fixing member for at least one part of a time period between a time at which the tailing end of the precedent recording medium is conveyed out from the nip and a time at which the leading end of the following recording medium is conveyed into the nip when the surface temperature of the pressure member detected by the second temperature detection mechanism is below a predetermined temperature.

7. The image forming apparatus according to claim 5, wherein the pressure adjustment mechanism gradually adjusts the contact pressure during the conveyance of the recording medium between the fixing member and the pressure member such that a width of the nip formed between the fixing member and the pressure member increases with decrease in the surface temperature of the fixing member detected by the first temperature detection mechanism.

8. The image forming apparatus according to claim 5, wherein the pressure adjustment mechanism performs at least one of adjustment to the contact pressure to be a minimum pressure or separation of the pressure member from the fixing member such that the surface temperature of the fixing member reaches a target temperature when the fixing member is heated during a start-up time.

9. The image forming apparatus according to claim 5, further comprising a registration member which adjusts a feed timing of each of the plurality of recording medium during the successive conveyance of the plurality of recording media between the fixing member and the pressure member such that a gap between the tailing end of the precedent recording medium and the leading end of the following recording medium widens when the surface temperature of the fixing member detected by the first temperature detection mechanism is below the predetermined temperature.

* * * * *